US008652016B2

(12) United States Patent
Grand

(10) Patent No.: US 8,652,016 B2
(45) Date of Patent: Feb. 18, 2014

(54) COLLAPSIBLE AND EXPANDIBLE EXERCISE WEIGHT

(76) Inventor: Gerard Grand, St. Catherines (CA)

( * ) Notice: Subject to any disclaimer, the term of this patent is extended or adjusted under 35 U.S.C. 154(b) by 0 days.

(21) Appl. No.: 12/621,160

(22) Filed: Nov. 18, 2009

(65) Prior Publication Data

US 2010/0222186 A1 Sep. 2, 2010

Related U.S. Application Data

(60) Provisional application No. 61/115,610, filed on Nov. 18, 2008.

(51) Int. Cl.
*A63B 21/072* (2006.01)

(52) U.S. Cl.
USPC ..... 482/107; 482/106; 482/108

(58) Field of Classification Search
USPC ..... 482/106–108; D21/680, 681; 215/382; 220/666
See application file for complete search history.

(56) References Cited

U.S. PATENT DOCUMENTS

| | | | | | |
|---|---|---|---|---|---|
| 3,836,141 | A * | 9/1974 | Franklyn | ..... | 482/112 |
| 3,939,888 | A * | 2/1976 | Scarnato | ..... | 220/666 |
| 4,248,421 | A * | 2/1981 | Salazar | ..... | 482/112 |
| 4,492,313 | A * | 1/1985 | Touzani | ..... | 215/372 |
| 4,905,992 | A * | 3/1990 | McWain | ..... | 482/106 |
| 4,997,184 | A * | 3/1991 | Sherman | ..... | 482/108 |
| 5,573,129 | A * | 11/1996 | Nagata et al. | ..... | 215/382 |
| 5,584,413 | A * | 12/1996 | Jung | ..... | 220/666 |
| D394,212 | S * | 5/1998 | Mazda | ..... | D9/557 |
| D397,933 | S * | 9/1998 | Mazda | ..... | D9/683 |
| 6,223,932 | B1 * | 5/2001 | Usui | ..... | 220/666 |
| 6,758,795 | B2 * | 7/2004 | Barber | ..... | 482/106 |
| 2010/0144498 | A1 * | 6/2010 | Barber | ..... | 482/108 |

* cited by examiner

*Primary Examiner* — Glenn Richman

(57) ABSTRACT

A collapsible exercise weight comprises a first end wall portion, a second end wall portion and a peripheral outer wall that together define a substantially hollow interior. A capped aperture permits the ingress of water into and the egress of water from the substantially hollow interior. A handle connector is for connecting the collapsible exercise weight to a handle. The peripheral outer wall comprises a plurality of wide diameter bellows folds and a plurality of narrow diameter bellows folds disposed alternatingly one with the other. The wide diameter bellows folds and the narrow diameter bellows folds are each movable between an expanded configuration and a collapsed configuration. The narrow diameter bellows folds at least partially fit within adjacent ones of the wide diameter bellows folds when the narrow diameter bellows folds are in the collapsed configuration.

9 Claims, 7 Drawing Sheets

SECTION A-A
160.0
444.7
134.6

SECTION A-A
160.0
304.5
64.5
29,22

SECTION A-A
130.0
18.5
487.2
0.2

SECTION A-A
SECTION B-B
Ø81.0
Ø26.0
Ø18.0
Ø22.0
16.0
26.0
18.0
2.0°
3.0
6.0
2.0
R2.0
Ø74.0
164
165
166
167
167a 181
1%
1%

183
2.9
181
15.0
11.1
182

0.6
A
A
B
B
181
6.0
182

183
185
183
1%
181
196
185
182
181

196
181
182

181

191
192
193
194
195
186
A
C
2.9
15.0
11.1
30.0
0.6
6.0

COLLAPSIBLE AND EXPANDIBLE EXERCISE WEIGHT

This application is a non-provisional application claiming priority to U.S. Provisional Patent Application Ser. No. 61/115,610 filed on Nov. 18, 2008, which is herein incorporated by reference.

FIELD OF THE INVENTION

The present invention relates to a collapsible and expandible exercise weight, and more particularly to a collapsible and expandible exercise weight that retains liquids.

BACKGROUND OF THE INVENTION

Portable exercise equipment, in various forms, has been known for many years. One of the recently more popular types of portable exercise equipment are various types of portable dumbbells. It is often difficult to travel with conventional dumbbells as they are somewhat heavy, by design and necessity. Accordingly, many types of water fillable dumbbells have become more common recently in order to permit ready carrying of these dumbbells in a suitcase or the like, without taking up too much room or being overly heavy, especially for airline travel.

One significant problem with water fillable dumbbells is that of adjustability of weight in order to provide the user with a selection of weight values depending on the exercise that is being done.

One such patent that discloses a system for accurately indexing water fillable dumbbell so that various selected weights can be achieved can be found in U.S. Pat. No. 6,758,795 issued Jul. 6, 2004 to Barber, and entitled Adjustable Water-Fillable Exercise Weights. These exercise weights comprise a readily portable dumbbell or barbell for exercising and weight training, in which weight units on an elongate handle comprise front and rear end plates interconnected by a collapsable/expandable fluid receptacle in the form of a resilient bellows. The weight unit is lengthened and expanded in order to accommodate fluid being added, and is shortened and decreased in volume corresponding to the fluid being removed. Although it is possible to retain the weight unit at its maximum size for any amount of water contained therein, this is generally unacceptable as the water would slosh around during exercising, which is unacceptable because it would be distracting and also because the forces involved in the water sloshing around would interfere with proper exercising. A calibration means is provided for visually indicating the weight of the unit corresponding to the longitudinal spacing between the front and end plates of the unit. In a preferred embodiment, a visually readable measure of weight is provided by means for a graduated bar insert which extends slidably within the hollow handle of the dumbbell or barbell and moves there along with expansion or contraction of the water-filled bellows.

Although the water-fillable dumbbell disclosed in the Barber patent does work well, it has been found that it may not be cost effective to manufacture.

U.S. Pat. No. 5,626,543 issued May 6, 1997 to Chen, discloses a Bellows-Like Exerciser that includes a bellows and a pair of gripping units attached to the bellows. The bellows include an elongate wall body that is made from a compressible and expandable resilient material and which defines a sealed interior chamber therein. The wall body has a first end portion, a second end portion and plurality of pleated sections located between and formed integrally with the end portions thereof. The first end portion has a radially extending circular orifice which is formed through a wall thereof and which has a predetermined diameter for permitting air to enter into an exit from the interior chamber only via the orifice. The gripping units are respectively attached to the first and second end portions of the wall body such as the wall body can be compressed or stretched by applying a force on the first and second end portions so as to vary the volume of the chamber in the wall body, thereby enabling the user to achieve an alternate pull and push exercising effects on a user. This bellows-like exerciser does not have means to permit the bellows to be retained at a specific size or displacement.

It is an object of the present invention to provide a collapsible and expandible exercise weight.

It is another object of the present invention to provide a collapsible and expandible exercise weight having a bellows type peripheral wall.

It is a further object of the present invention to provide a collapsible and expandible exercise weight usable as part of an exercise dumbbell.

SUMMARY OF THE INVENTION

In accordance with one aspect of the present invention there is disclosed a novel collapsible exercise weight comprising a first end wall portion and a second end wall portion disposed in space relation from the first end wall portion. A peripheral outer wall is secured in sealed relation to the first end wall portion and the second end wall portion and extending therebetween, to together define a substantially hollow interior. An aperture in one of the first end wall portion and the second end wall portion to permit the ingress of water into and the egress of water from the substantially hollow interior. A removable and replaceable cap is for sealing off the aperture. The peripheral outer wall comprises a plurality of wide diameter bellows folds and a plurality of narrow diameter bellows folds disposed alternatingly one with the other. The wide diameter bellows folds and the narrow diameter bellows folds are each movable between an expanded configuration and a collapsed configuration. The narrow diameter bellows folds at least partially fit within adjacent ones of the wide diameter bellows folds when the narrow diameter bellows folds are in the collapsed configuration.

In accordance with another aspect of the present invention there is disclosed a novel collapsible exercise weight comprising a first end wall portion and a second end wall portion disposed in space relation from the first end wall portion. A peripheral outer wall is secured in sealed relation to the first end wall portion and the second end wall portion and extending therebetween, to together define a substantially hollow interior. An aperture in one of the first end wall portion and the second end wall portion to permit the ingress of water into and the egress of water from the substantially hollow interior. A removable and replaceable cap is for sealing off the aperture. The peripheral outer wall comprises a plurality of bellows folds each movable between an expanded configuration and a collapsed configuration. The bellows folds are made from a bi-stable plastic material.

In accordance with another aspect of the present invention there is disclosed a novel collapsible exercise weight comprising a first end wall portion and a second end wall portion disposed in space relation from the first end wall portion. A peripheral outer wall is secured in sealed relation to the first end wall portion and the second end wall portion and extending therebetween, to together define a substantially hollow interior. An aperture in one of the first end wall portion and the second end wall portion to permit the ingress of water into and the egress of water from the substantially hollow interior. A removable and replaceable cap is for sealing off the aperture. The peripheral outer wall comprises a plurality of bellows folds each movable between an expanded configuration and a collapsed configuration. The bellows folds comprise curved outer peripheral portions and curved inner peripheral portions connected one to the next by angled portions. The peripheral outer wall has a thickness of about one third the radius of curvature of the curved outer peripheral portions and the curved inner peripheral portions have a thickness of about one third the radius of curvature of the curved inner peripheral portions.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the collapsible and expandible exercise weight according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figures 1, 2, 3, 4, 5:
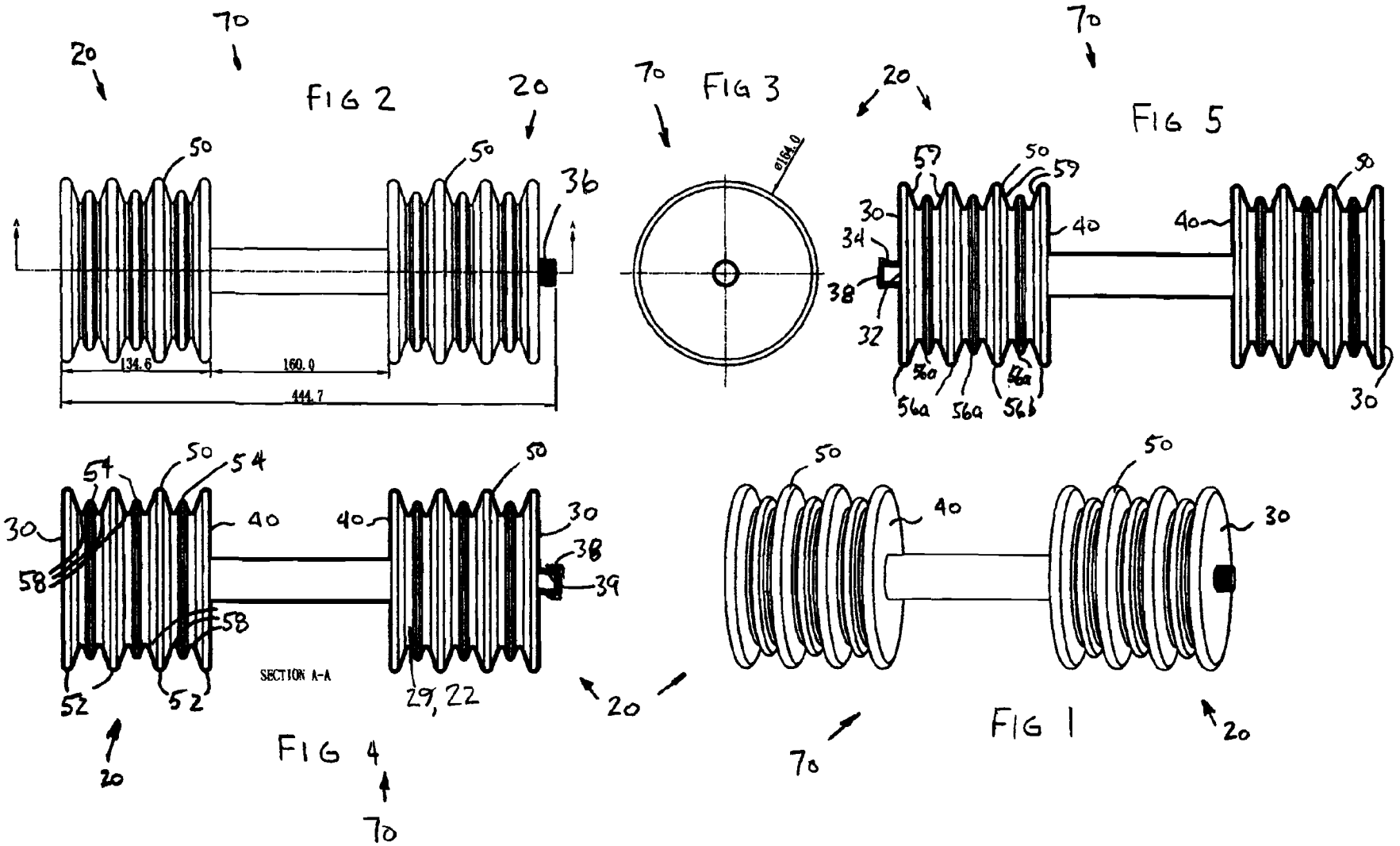
FIG. 1 is a perspective view of the first preferred embodiment of the collapsible and expandible exercise weight according to the present invention, with two collapsible and expandible exercise weights integrally formed into an exercise dumbbell, and with the bellows in a fully expanded configuration.
FIG. 2 is a side elevational view of the first preferred embodiment of the collapsible and expandible exercise weight and exercise dumbbell of FIG. 1.
FIG. 3 is an end elevational view of the first preferred embodiment of the collapsible and expandible exercise weight and exercise dumbbell of FIG. 1.
FIG. 4 is a sectional side elevational view of the first preferred embodiment of the collapsible and expandible exercise weight and exercise dumbbell of FIG. 1, taken along section line 4-4 in FIG. 2.
FIG. 5 is a sectional side elevational view of the first preferred embodiment of the collapsible and expandible exercise weight and exercise dumbbell of FIG. 1, taken along section line 5-5 in FIG. 2.
Figures 6, 7, 8, 9, 10:
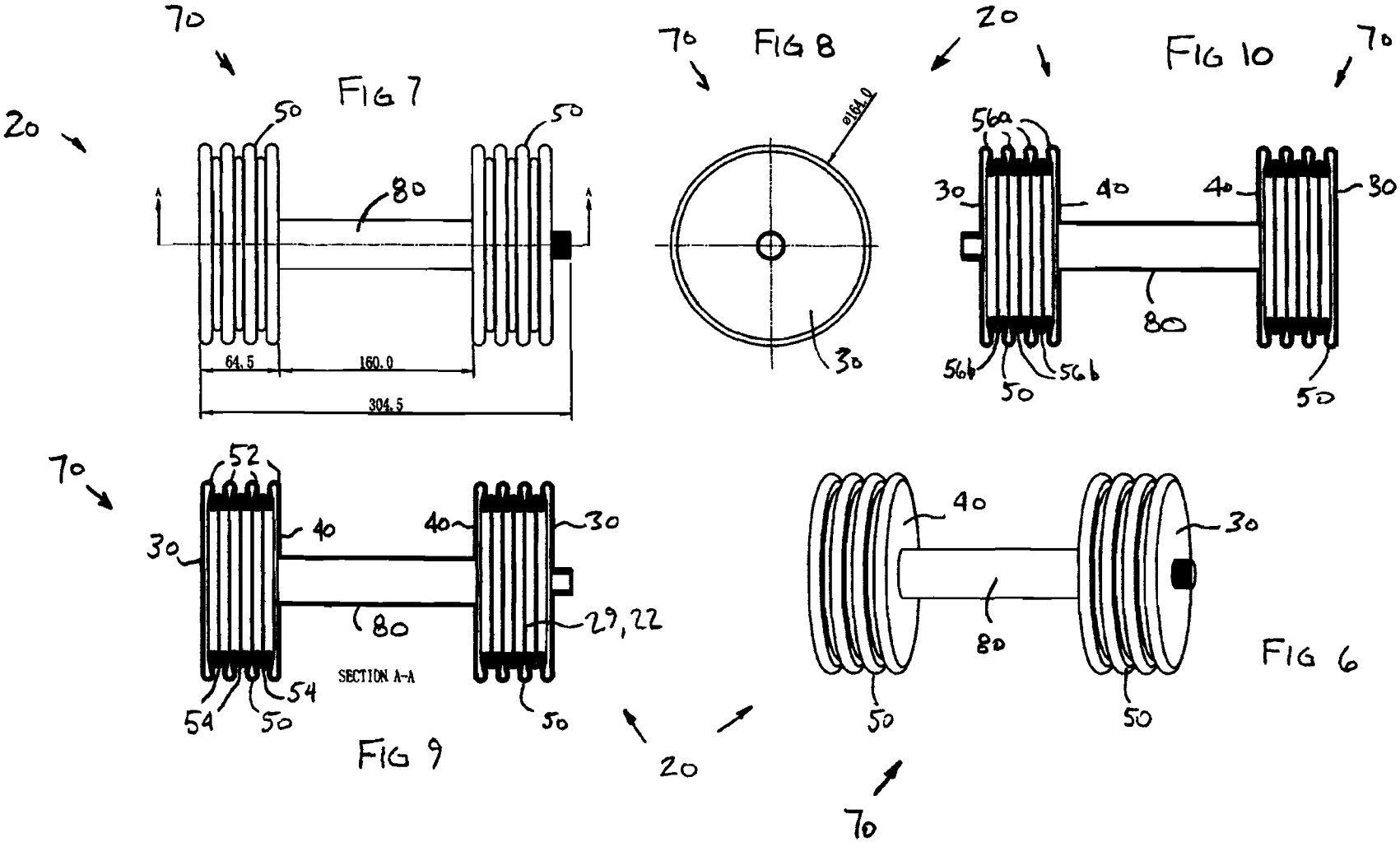
FIG. 6 is a perspective view of the first preferred embodiment of the collapsible and expandible exercise weight according to the present invention, with two collapsible and expandible exercise weights integrally formed into an exercise dumbbell, and with the bellows in a fully retracted configuration.
FIG. 7 is a side elevational view of the first preferred embodiment of the collapsible and expandible exercise weight and exercise dumbbell of FIG. 6.
FIG. 8 is an end elevational view of the first preferred embodiment of the collapsible and expandible exercise weight and exercise dumbbell of FIG. 6.
FIG. 9 is a sectional side elevational view of the first preferred embodiment of the collapsible and expandible exercise weight and exercise dumbbell of FIG. 6, taken along section line 9-9 in FIG. 7.
FIG. 10 is a sectional side elevational view of the first preferred embodiment of the collapsible and expandible exercise weight and exercise dumbbell of FIG. 1, taken along section line 10-10 in FIG. 7.
Figures 11, 12, 13, 14, 15:
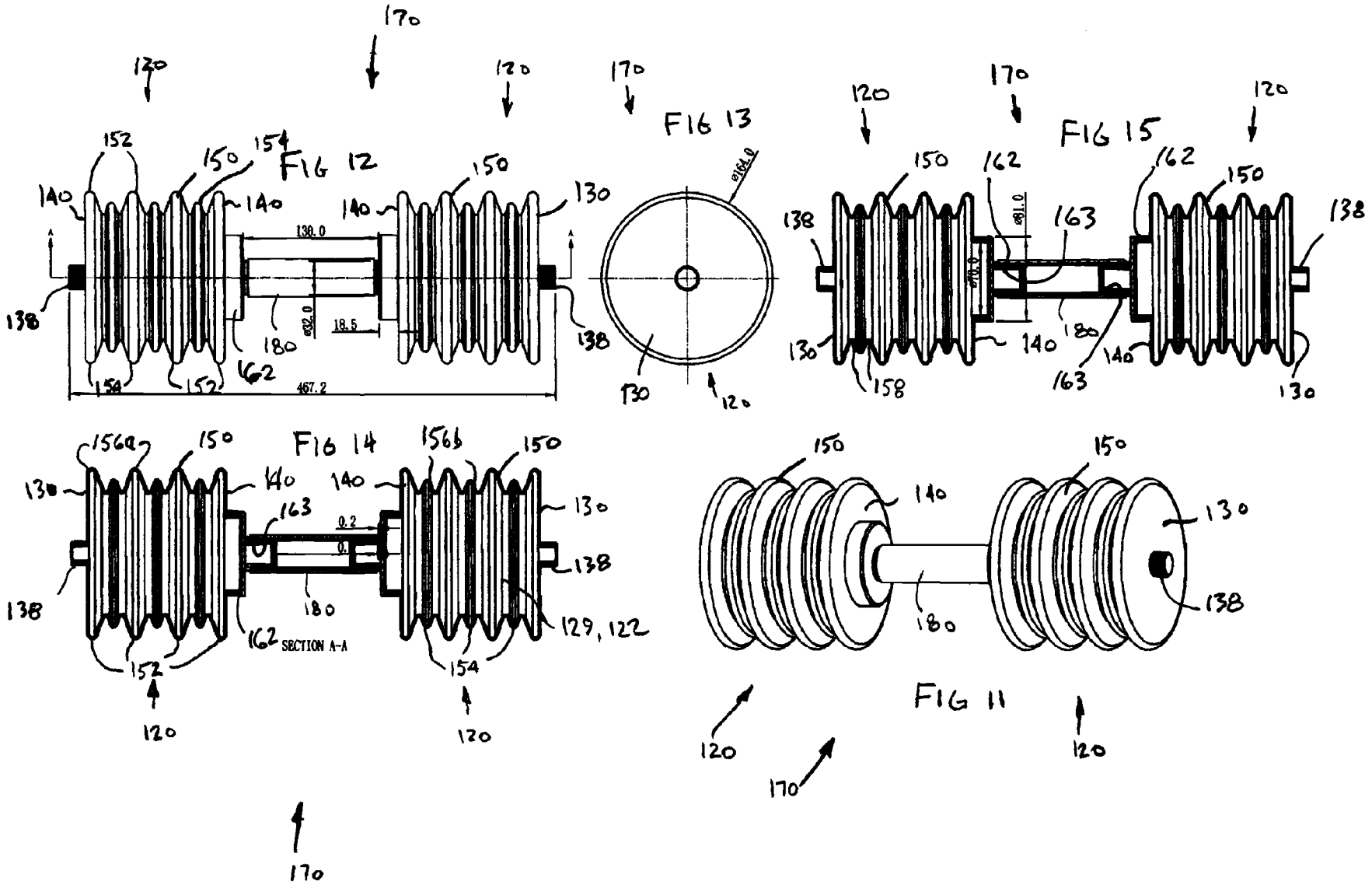
FIG. 11 is a perspective view of the second preferred embodiment of the collapsible and expandible exercise weight according to the present invention, with two collapsible and expandible exercise weights assembled into an exercise dumbbell, and with the bellows in a fully expanded configuration.
FIG. 12 is a side elevational view of the second preferred embodiment of the collapsible and expandible exercise weight and exercise dumbbell of FIG. 11.
FIG. 13 is an end elevational view of the second preferred embodiment of the collapsible and expandible exercise weight and exercise dumbbell of FIG. 11.
FIG. 14 is a sectional side elevational view of the second preferred embodiment of the collapsible and expandible exercise weight and exercise dumbbell of FIG. 11, taken along section line 14-14 in FIG. 12.
FIG. 15 is a sectional side elevational view of the second preferred embodiment of the collapsible and expandible exercise weight and exercise dumbbell of FIG. 11, taken along section line 15-15 in FIG. 12.
Figure 17:
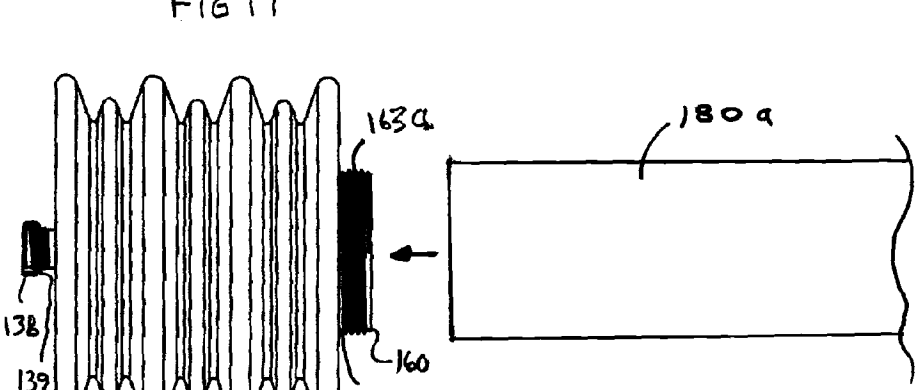
FIG. 17 is a side elevational view of the second preferred embodiment of the collapsible and expandible exercise weight of FIG. 16.
Figure 16:
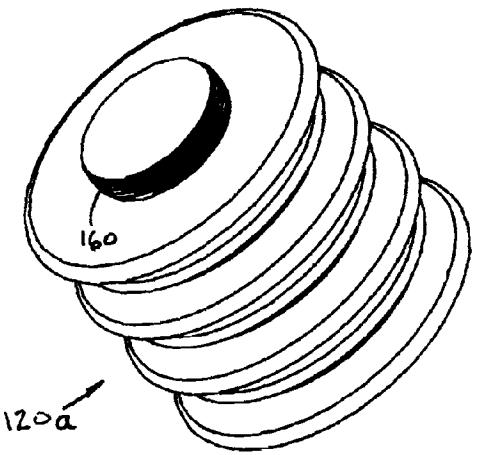
FIG. 16 is a perspective view of the second preferred embodiment of the collapsible and expandible exercise weight according to the present invention, but with a first alternative embodiment handle and handle connection means.
Figure 19:
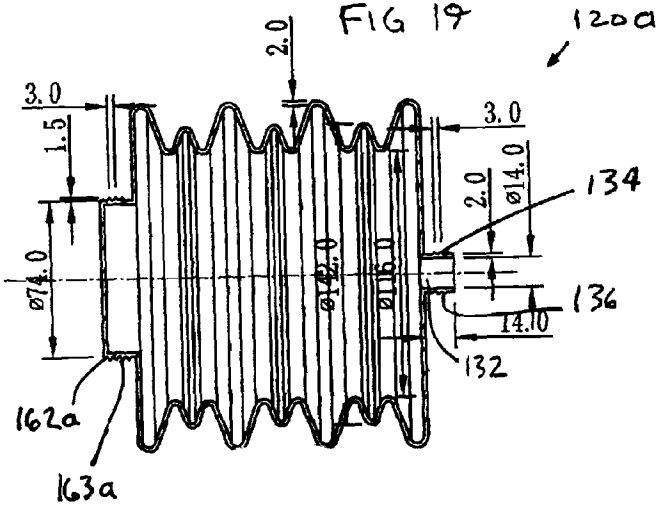
FIG. 19 is a sectional side elevational view of the second preferred embodiment of the collapsible and expandible exercise weight of FIG. 16, taken along section line 19-19 in FIG. 18.
Figure 18:
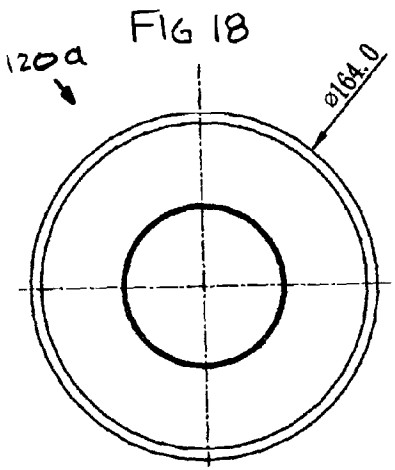
FIG. 18 is an end elevational view of the second preferred embodiment of the collapsible and expandible exercise weight of FIG. 16.
Figures 20, 21, 22, 23, 24:
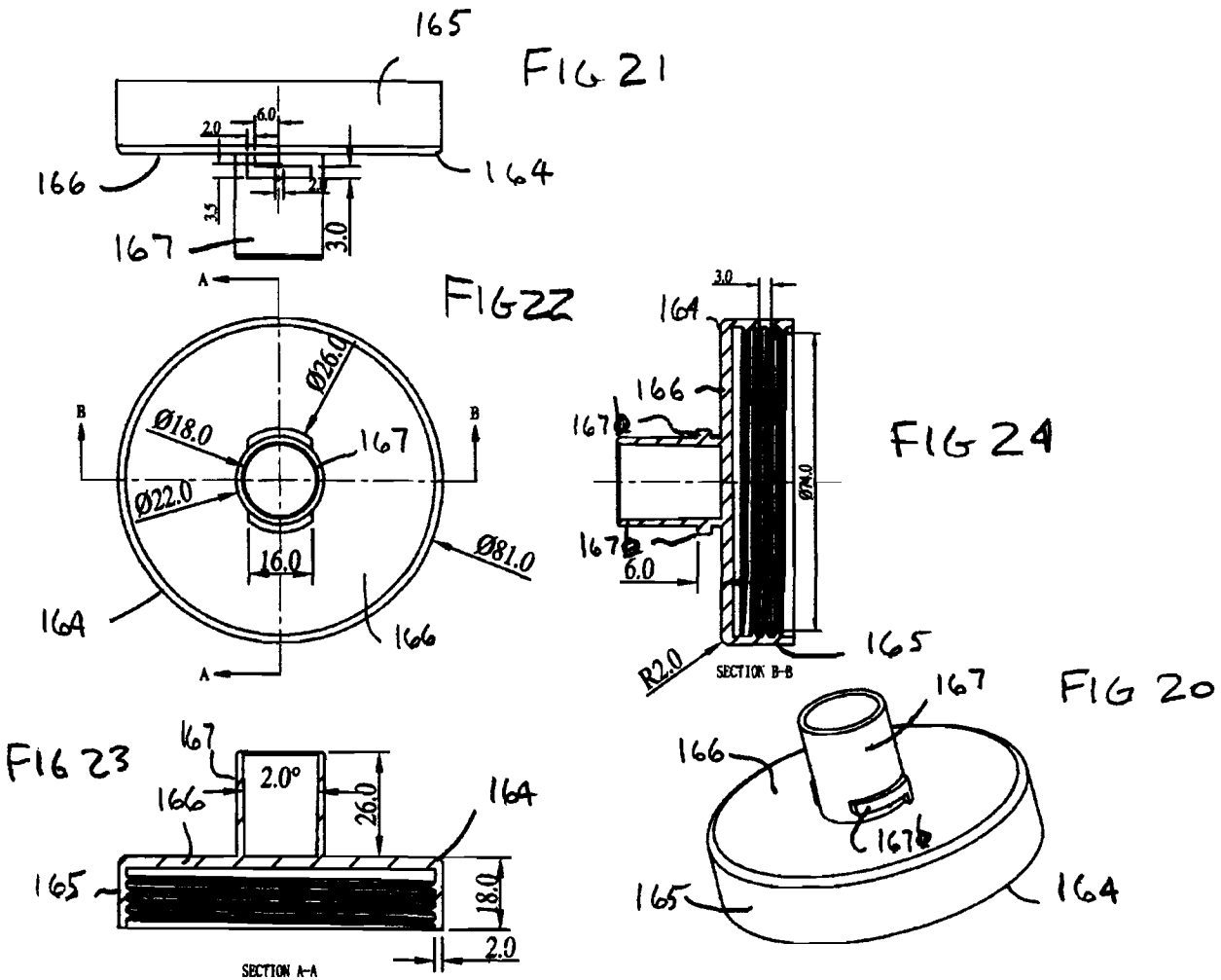
FIG. 20 is a perspective view of the connector used in the second preferred embodiment of the collapsible and expandible exercise weight of FIG. 11, but with a second alternative embodiment handle and handle connection means.
FIG. 21 is a side elevational view of the connector used in the second preferred embodiment of the collapsible and expandible exercise weight and exercise dumbbell of FIG. 20, with the second alternative embodiment handle and handle connection means.
FIG. 22 is an end elevational view of the connector used in the second preferred embodiment of the collapsible and expandible exercise weight and exercise dumbbell of FIG. 21.
FIG. 23 is a sectional side elevational view of the connector used in the second preferred embodiment of the collapsible and expandible exercise weight and exercise dumbbell of FIG. 21, taken along section line 23-23 in FIG. 22.
FIG. 24 is a sectional side elevational view of the connector used in the second preferred embodiment of the collapsible and expandible exercise weight and exercise dumbbell of FIG. 21, taken along section line 24-24 in FIG. 22.
Figures 25, 26, 27, 28, 29, 30:
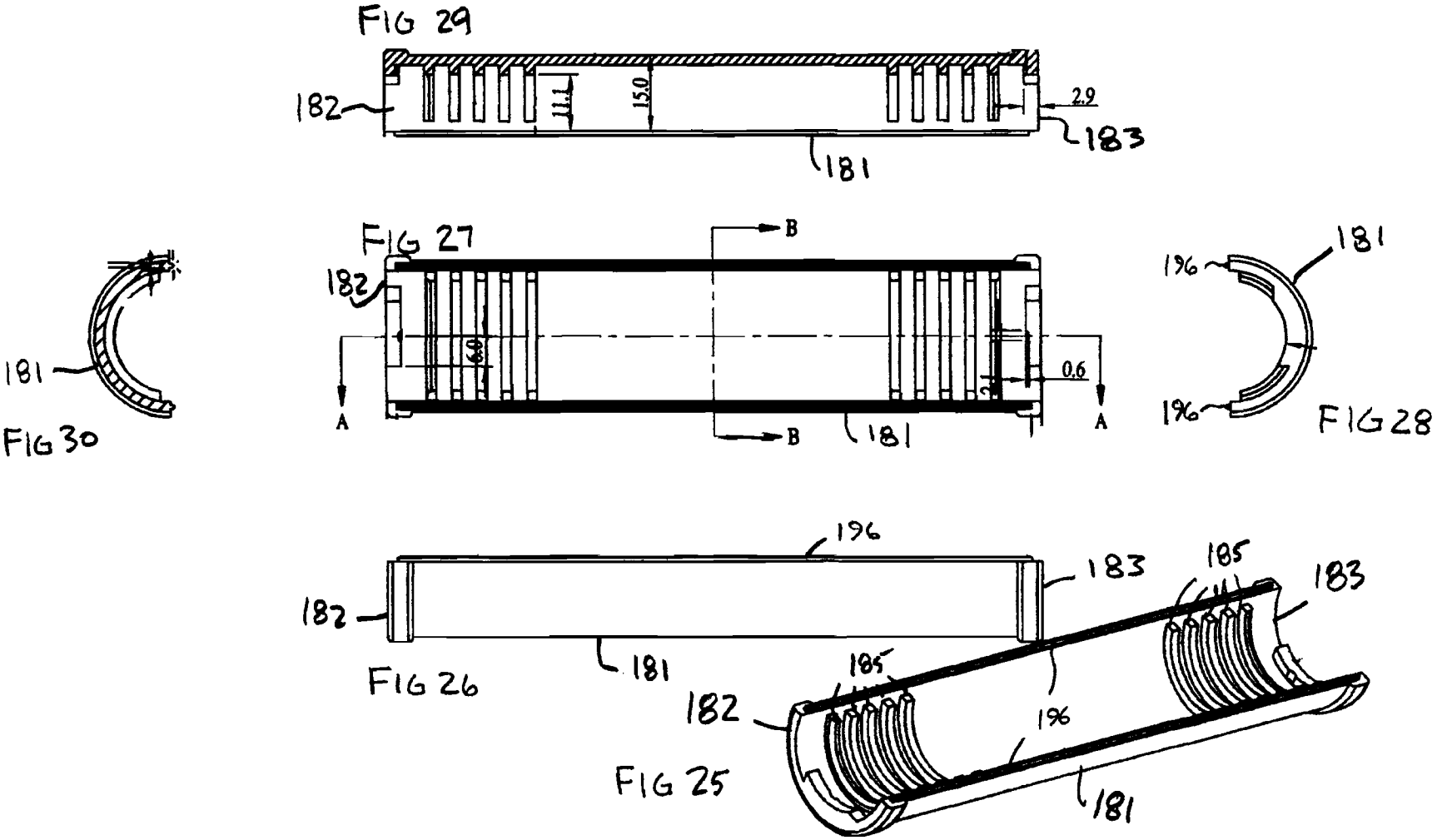
FIG. 25 is a perspective view of a first portion of the handle used in the second preferred embodiment of the collapsible and expandible exercise weight in conjunction with the connector of FIGS. 20 through 24.
FIG. 26 is a side elevational view of a first portion of the handle used in the second preferred embodiment of the collapsible and expandible exercise weight in conjunction with the connector of FIGS. 20 through 24.
FIG. 27 is a top plan view of a first portion of the handle used in the second preferred embodiment of the collapsible and expandible exercise weight in conjunction with the connector of FIGS. 20 through 24.
FIG. 28 is an end elevational view of a first portion of the handle used in the second preferred embodiment of the collapsible and expandible exercise weight in conjunction with the connector of FIGS. 20 through 24.
FIG. 29 is a sectional side elevational view of a first portion of the handle used in the second preferred embodiment of the collapsible and expandible exercise weight in conjunction with the connector of FIGS. 20 through 24, taken along section line 29-29 in FIG. 28.
FIG. 30 is a sectional end elevational view of a first portion of the handle used in the second preferred embodiment of the collapsible and expandible exercise weight in conjunction with the connector of FIGS. 20 through 24, taken along section line 30-30 in FIG. 28.
Figures 31, 32, 33, 34, 35, 36:
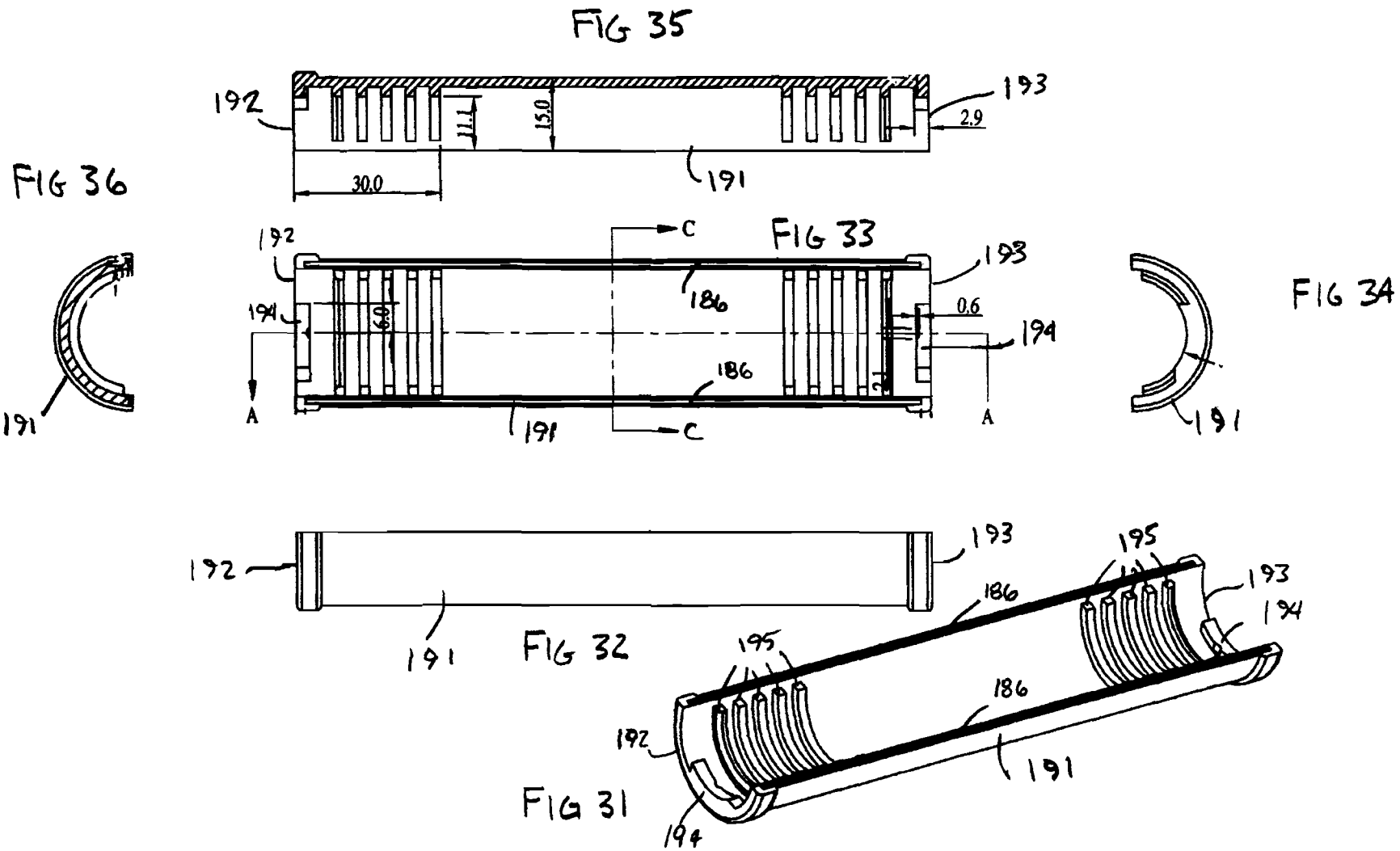
FIG. 31 is a perspective view of a second portion of the handle used in the second preferred embodiment of the collapsible and expandible exercise weight in conjunction with the connector of FIGS. 20 through 24.
FIG. 32 is a side elevational view of a second portion of the handle used in the second preferred embodiment of the collapsible and expandible exercise weight in conjunction with the connector of FIGS. 20 through 24.
FIG. 33 is a top plan view of a second portion of the handle used in the second preferred embodiment of the collapsible and expandible exercise weight in conjunction with the connector of FIGS. 20 through 24.
FIG. 34 is an end elevational view of a second portion of the handle used in the second preferred embodiment of the collapsible and expandible exercise weight in conjunction with the connector of FIGS. 20 through 24.
FIG. 35 is a sectional side elevational view of a second portion of the handle used in the first preferred embodiment of the collapsible and expandible exercise weight in conjunction with the connector of FIGS. 20 through 24, taken along section line 35-35 in FIG. 34; and, FIG. 36 is a sectional end elevational view of a second portion of the handle used in the second preferred embodiment of the collapsible and expandible exercise weight in conjunction with the connector of FIGS. 20 through 24, taken along section line 36-36 in FIG. 34.

Referring to FIGS. 1 through 36 of the drawings, it will be noted that FIGS. 1 through 10 illustrate a first preferred embodiment of the collapsible and expandible exercise weight and exercise dumbbell of the present invention, and FIGS. 11 through 36 illustrate a second preferred embodiment of the collapsible and expandible exercise weight and exercise dumbbell of the present invention.

Reference will now be made to FIGS. 1 through 10, which show a first preferred embodiment of the collapsible liquid container of the present invention, as indicated by general reference numeral 20. The collapsible exercise weight 20 comprises a first end wall 30 portion and a second end wall portion 40 disposed in spaced relation from the first end wall 30 portion. Preferably, but not necessarily, the first end wall portion 30 and the second end wall portion 40 are each substantially circular and each substantially the same diameter one as the other.

A peripheral outer wall 50 is connected in sealed relation to the first end wall 30 portion and the second end wall portion 40 and extending therebetween, to together define a substantially hollow interior 29. The substantially hollow interior 29 receives a liquid 22 therein, preferably water, in order to provide a readily removable and replaceable source of weight for the collapsible exercise weight 20.

The first end wall 30 portion, the second end wall portion 40, and the peripheral outer wall 50 are each a unitary structure, are preferably made from a suitable rigid plastic material such as high density polyethylene, but may be made from any other suitable material. Further, the first end wall 30 portion and the second end wall portion 40 are of a thickness that allows them to be substantially rigid and also weight bearing in the order of a few kilograms, depending on the exact size of the collapsible exercise weight 20.

An aperture 32 in one of the first end wall portion 30 and the second end wall portion 40 permits the ingress of water into and the egress of water from the substantially hollow interior 29. In the first preferred embodiment, as illustrated, the aperture 32 is disposed in the first end wall portion 30 and is defined by an outwardly projecting annular wall portion 34 having an external thread 36. There is also a removable and replaceable cap 38 for sealing off the aperture 32. The removable and replaceable cap 38 has an internal thread 39 and is threadibly engaged on the external thread 36 of the outwardly projecting annular wall portion 34.

The peripheral outer wall 50 comprises a plurality of bellows folds each movable between an expanded configuration and a collapsed configuration. More specifically, the peripheral outer wall 50 comprises a plurality of wide diameter bellows folds 52 and a plurality of narrow diameter bellows folds 54 disposed alternatingly one with the other. Preferably, the wide diameter bellows folds 52 are each substantially the same diameter one as the other and the narrow diameter bellows folds 54 are each substantially the same diameter one as the other. Also, as illustrated, but not necessarily, the wide diameter bellows folds 52 are each substantially the same diameter as said first end wall portion 30 and said second end wall portion 40.

The wide diameter bellows folds 52 and the narrow diameter bellows folds 54 are each movable between an expanded configuration, as shown in FIGS. 1 through 5, and a collapsed configuration, as shown in FIGS. 6 through 10. The narrow diameter bellows folds 54 at least partially fit within adjacent ones of the wide diameter bellows folds 52 when the narrow diameter bellows folds 54 are in the collapsed configuration.

Further, the bellows folds are made from a bi-stable plastic material in order to cause the various wide diameter bellows folds 52 and narrow diameter bellows folds 54 of the peripheral outer wall 50 to remain in either one of the expanded configuration and the collapsed configuration, as the case may be, unless specifically manually moved to the other one of the expanded configuration and the collapsed configuration.

Also, as can readily be seen from the figures, the wide diameter bellows folds 52 comprise curved outer peripheral portions **56*a* and the narrow diameter bellows folds 54 comprise curved outer peripheral portions 56*b*. There are also curved inner peripheral portions 58. The curved outer peripheral portions 56*a* and the curved outer peripheral portions 56*b* are interconnected to the curved inner peripheral portions 58 by angled portions 59. The peripheral outer wall 50 has a thickness of about one third to about one fifth the radius of curvature of the curved outer peripheral portions 56***a*, 56*b*, and the curved inner peripheral portions 58.

The first preferred embodiment exercise dumbbell, as indicated by general reference numeral 70, comprises two first preferred embodiment collapsible exercise weights 20 and a handle 80 that are integrally formed one with the others preferably by blow molding.

Reference will now be made to FIGS. 11 through 36, which show a second preferred embodiment of the collapsible exercise weight of the present invention, as indicated by general reference numeral 120. The second preferred embodiment collapsible exercise weight 120 is very similar to the first preferred embodiment collapsible exercise weight 20, except that the collapsible exercise weights 120 and the handle (indicated as reference numeral 180 in a FIGS. 11 through 15, shown as a first alternative embodiment and indicated as reference numeral 180*a* in a FIGS. 16 through 19, and shown as a second alternative embodiment and indicated as reference numeral 180*b* in a FIGS. 20 through 35), are not integrally formed one with the others. The second preferred embodiment exercise dumbbell, as indicated by general reference numeral 170, comprises two second preferred embodiment collapsible exercise weights 120 and a handle 180 (or 180*a*, or 180*b*).

The second preferred embodiment collapsible exercise weight 120 comprises a first end wall 130 portion and a second end wall portion 140 disposed in space relation from the first end wall 130 portion. The first end wall 130 portion and the second end wall portion 140 are preferably made from a suitable rigid plastic material such as high density polyethylene, but may be made from any other suitable material. Further, the first end wall 130 portion and the second end wall portion 140 are of a thickness that allows them to be rigid and also weight bearing in the order of a few kilograms, depending on the exact size of the collapsible exercise weight 120.

A peripheral outer wall 150 is secured in sealed relation to the first end wall 130 portion and the second end wall portion 140 and extending therebetween, to together define a substantially hollow interior 129. The substantially hollow interior 129 receives a liquid 122 therein, preferably water, in order to provide a readily removable and replaceable source of weight for the collapsible exercise weight 120.

An aperture 132 in one of the first end wall portion 130 and the second end wall portion 140 permits the ingress of water into and the egress of water from the substantially hollow interior 129. In the first preferred embodiment, as illustrated, the aperture 132 is disposed in the first end wall portion 130 and is defined by an outwardly projecting annular wall portion 134 having an external thread 136. There is also a removable and replaceable cap 138 for sealing off the aperture 132. The removable and replaceable cap 138 has an internal thread 139 and is threadibly engaged on the external thread 136 of the outwardly projecting annular wall portion 134.

A handle connection means 160 is disposed on one of the first end wall portion 130 and the second end wall portion 140 for connecting the collapsible exercise weight 120 to a handle 180. In the second preferred embodiment, as illustrated in FIGS. 11 through 15, the handle connection means 160 is disposed in the second end wall portion 140 and comprises a wide diameter outwardly projecting annular wall portion 162 and a narrower outwardly projecting annular wall portion 163 onto which the handle 180 fits.

In a first alternative embodiment, as illustrated in FIGS. 16 through 19, the collapsible exercise weight 120*a* is threadibly engaged onto the handle 180*a*. The handle connection means 160 is disposed in the second end wall portion 140 and comprises a wide diameter outwardly projecting annular wall portion 162*a* having an external thread 163*a*. The end of the handle 180*a* threadibly engages the onto the wide diameter outwardly projecting annular wall portion 162*a*.

In a second alternative embodiment, as illustrated in FIGS. 20 through 35, the collapsible exercise weight 120*b* is engaged onto the handle 180*b* via the handle connection means 160 that comprises an outwardly projecting annular wall portion 162*b* having a protrusion 167*b* with an undercut. The end of the handle 180*b* (shown in FIGS. 25 through 35) locks onto the outwardly projecting annular wall portion 162*b*.

The peripheral outer wall 150 comprises a plurality of bellows folds each movable between an expanded configuration and a collapsed configuration. More specifically, the peripheral outer wall 150 comprises a plurality of wide diameter bellows folds 152 and a plurality of narrow diameter bellows folds 154 disposed alternatingly one with the other. The wide diameter bellows folds 152 and the narrow diameter bellows folds 154 are each movable between an expanded configuration and a collapsed configuration. The narrow diameter bellows folds 154 at least partially fit within adjacent ones of the wide diameter bellows folds 152 when the narrow diameter bellows folds 154 are in the collapsed configuration.

Further, the bellows folds are made from a bi-stable plastic material in order to cause the various wide diameter bellows folds 152 and narrow diameter bellows folds 154 of the peripheral outer wall 150 to remain in either one of the expanded configuration and the collapsed configuration, as the case may be, unless specifically manually moved to the other one of the expanded configuration and the collapsed configuration.

Also, as can readily be seen from the figures, the wide diameter bellows folds 152 comprise curved outer peripheral portions 156*a* and the narrow diameter bellows folds 154 comprise curved outer peripheral portions 156*b*. There are also curved inner peripheral portions 158. The curved outer peripheral portions 156*a* and the curved outer peripheral portions 156*b* are interconnected to the curved inner peripheral portions 158 by angled portions 159. The peripheral outer wall 150 has a thickness of about one third to about one fifth the radius of curvature of the curved outer peripheral portions 156*a*, 156*b*, and the curved inner peripheral portions 158.

Reference will now be made to FIGS. 25 through 35, which show the second alternative embodiment handle 180*b*. The handle 180*b* comprises a first handle portion 181, as shown in FIGS. 25 through 30, and a second handle portion 191, as shown in FIGS. 31 through 36. Each end 182, 183 of the first handle portion 181 has an arcuate locking protrusion 184 that locks behind a cooperating protrusion 167*b* on the outwardly projecting annular wall portion 162*b* of the connector 160. A plurality of parallel internal reinforcing ribs 185 help provide structural strength for the first handle portion 181 of the handle 180. A plurality of parallel internal reinforcing ribs 195 help provide structural strength for the second handle portion 191 of the handle 190. Two elongate flanges 196 on the outers edges of the second handle portion 191 fit into cooperating slots 186 in the first handle portion 181 to cause the first handle portion 181 and the second handle portion 191 to be correctly aligned when secured together by a suitable adhesive or ultrasonic welding.

As can be understood from the above description and from the accompanying drawings, the present invention provides a collapsible liquid container, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the collapsible liquid container of the present invention without departing from the spirit and scope of the accompanying claims.

I claim:

1. A collapsible exercise weight comprising:

a first end wall portion;

a second end wall portion disposed in spaced relation from said first end wall portion;

a peripheral outer wall secured in sealed relation to said first end wall portion and said second end wall portion and extending therebetween, to together define a substantially hollow interior;

an aperture in one of said first end wall portion and said second end wall portion to permit the ingress of water into and the egress of water from said substantially hollow interior;

a removable and replaceable cap for sealing off said aperture;

wherein said peripheral outer wall comprises a plurality of wide diameter bellows folds and a plurality of narrow diameter bellows folds disposed alternatingly one with the other;

wherein said wide diameter bellows folds and said narrow diameter bellows folds are each movable between an expanded configuration and a collapsed configuration;

the wide diameter bellows folds comprise curved outer peripheral portions and the narrow diameter bellows folds comprise curved outer peripheral portions; and, wherein said narrow diameter bellows folds at least partially fit within adjacent ones of said wide diameter bellows folds when said narrow diameter bellows folds are in said collapsed configuration.

2. The collapsible exercise weight of claim 1, further comprising handle connection means disposed on one of said first end wall portion and said second end wall portion for connecting said collapsible exercise weight to a handle.

3. The collapsible exercise weight of claim 1, wherein said first end wall portion, said second end wall portion and said peripheral outer wall are integrally formed one with the other.

4. The collapsible exercise weight of claim 1, wherein said first end wall portion and said second end wall portion are, substantially rigid.

5. The collapsible exercise weight of claim 1, wherein said first end wall portion and said second end wall portion are each substantially circular.

6. The collapsible exercise weight of claim 5, wherein said narrow diameter bellows folds are each substantially the same diameter one as the other.

7. The collapsible exercise weight of claim 6, wherein said wide diameter bellows folds are each substantially the same diameter one as the other.

8. The collapsible exercise weight of claim 7, wherein said first end wall portion and said second end wall portion are each substantially the same diameter one as the other.

9. The collapsible exercise weight of claim 8, wherein said wide diameter bellows folds are each substantially the same diameter as said first end wall portion and said second end wall portion.

* * * * *